US006984149B2

(12) United States Patent
Fukuda et al.

(10) Patent No.: US 6,984,149 B2
(45) Date of Patent: Jan. 10, 2006

(54) WATERPROOF CONNECTOR

(75) Inventors: Masaru Fukuda, Shizuoka (JP); Harunori Tashiro, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/849,303

(22) Filed: May 20, 2004

(65) Prior Publication Data

US 2004/0235347 A1 Nov. 25, 2004

(30) Foreign Application Priority Data

May 21, 2003 (JP) ..... P. 2003-143613

(51) Int. Cl.
*H01R 13/40* (2006.01)

(52) U.S. Cl. ..... 439/587; 439/936; 439/701

(58) Field of Classification Search ..... 439/587–589, 439/936, 274, 275, 157, 701, 937
See application file for complete search history.

(56) References Cited

U.S. PATENT DOCUMENTS

| | | | | |
|---|---|---|---|---|
| 3,816,641 | A | 6/1974 | Iversen | |
| 4,335,932 | A | 6/1982 | Herrmann, Jr. | |
| 6,174,201 | B1 | 1/2001 | Murakami et al. | |
| 6,231,388 | B1 * | 5/2001 | Murakami et al. | 439/587 |
| 6,361,341 | B1 * | 3/2002 | Okayasu et al. | 439/271 |
| 6,364,703 | B1 * | 4/2002 | Ito | 439/589 |
| 6,390,848 | B1 * | 5/2002 | Murakami et al. | 439/587 |
| 6,398,571 | B1 * | 6/2002 | Nishide et al. | 439/275 |
| 6,527,586 | B2 * | 3/2003 | Okamura et al. | 439/587 |
| 6,638,108 | B2 * | 10/2003 | Tachi | 439/595 |
| 6,767,250 | B2 * | 7/2004 | Casses et al. | 439/587 |
| 6,773,278 | B2 * | 8/2004 | Valasek et al. | 439/157 |
| 2002/0031934 | A1 | 3/2002 | Hara et al. | |

FOREIGN PATENT DOCUMENTS

| | | |
|---|---|---|
| JP | 7-312259 | 11/1995 |
| JP | 2000-150058 | 5/2000 |
| JP | 2000-357557 | 12/2000 |

* cited by examiner

*Primary Examiner*—Gary Paumen
(74) *Attorney, Agent, or Firm*—Finnegan, Henderson, Farabow, Garrett & Dunner, L.L.P.

(57) ABSTRACT

A waterproof connector includes a tubular outer housing which has an opening, an inner housing which is inserted into the tubular outer housing and is held in the tubular outer housing and a vessel portion. The inner housing includes a plurality of terminal receiving chambers, a plurality of connection terminals which are provided on the terminal receiving chambers respectively, and a plurality of wires which are respectively connected to the connection terminals, and extends in the terminal receiving chambers toward an outside through the opening. The vessel portion is formed by an inner circumference of end portion of the tubular outer housing at an opening side and an end face of the inner housing from which the wires are extended toward the outside. A sealing material is filled in the vessel portion for waterproofing the wires collectively.

5 Claims, 16 Drawing Sheets

WATERPROOF CONNECTOR

BACKGROUND OF THE INVENTION

This invention relates to a waterproof connector, and more particularly to a waterproof connector in which a plurality of inner housings, each receiving connection terminals connected respectively to wires, are mounted in a stacked manner in an outer housing, and thereafter a sealing material is filled in a sealing material-filling vessel portion formed in a rear portion of the outer housing, thereby collectively waterproofing the plurality of wires.

There are known various related waterproof connectors in which a sealing material is filled in the connector to effect a waterproof treatment so that water or others will not intrude into the connector. There is disclosed one such waterproof connector in which a housing comprises a body having a terminal support portion on which connection terminals are placed, and a lid. The connection terminals are placed on the terminal support portion coated with butyl rubber, and the lid, coated with butyl rubber, is put on the terminal support portion, thereby effecting the waterproofing (see, for example, JP-A-7-312259 (pages 2 to 3, FIG. 1)).

In the waterproof connector disclosed in JP-A-7-312259, butyl rubber is coated on the terminal support portion of the body having the connection terminal placed thereon, and then the cover or the like is put on the terminal support portion, thereby effecting the waterproofing. Therefore, it is difficult to form this connector into a multi-pole design by stacking and arranging the connection terminals in a multi-stage manner in an upward-downward direction, and therefore this connector could not meet requirements for an automobile connector or the like to which a large number of wires need to be connected.

As a waterproof connector solving the above problem, there has been proposed a multi-pole connector in which a plurality of sub-connectors are received in respective holders within a frame, and a collective-type rubber plug and a collective-type rubber plug holder (which are common to the plurality of sub-connectors) are provided at rear surfaces of the sub-connectors so as to effect a waterproof treatment (see, for example, JP-A-2000-150058 (pages 3 to 5, FIG. 1)).

There is also disclosed a connector in which a connector housing comprises inner housings each comprising a plurality of division inner units each having terminal receiving chambers, a space for receiving the plurality of division inner units in a stacked manner, and an outer housing for receiving the spacer. A rubber plug is received in a rubber plug-receiving recess formed in the outer housing, and wires are passed through the rubber plug, thereby waterproofing the wires (see, for example, JP-A-2000-357557 (pages 5 to 7, FIG. 1), which correspond to U.S. patent application 6174201B1).

In the waterproof connector disclosed in JP-A-2000-150058, connection terminals are inserted into the sub-connectors having the rubber plug fixed to the rear surfaces thereof, and the sub-connectors are received in the respective holders within the frame, thereby providing the multi-pole design, and the wires are waterproofed by the rubber plug.

In the waterproof connector disclosed in JP-A-2000-357557, the spacer is fitted in the outer housing, with the rubber plug held therebetween, and the wires are passed through the rubber plug, and are connected respectively to connection terminals received in the inner housings. Then, the inner housings are received in the outer housing, and the waterproof treatment is effected by the rubber plug.

In the waterproof connectors disclosed respectively in JP-A-2000-150058 and JP-A-2000-357557, a number of wire harnesses are divided into predetermined numbers of groups to provide sub-wire harnesses, using the inner housings comprising the sub-connectors or the division inner units, and then these sub-wire harnesses are combined together to provide the multi-pole connector. The waterproof treatment is completed for each sub-wire harness by passing the wires one by one through the rubber plug, and therefore there have been encountered problems that the assembling process is complicated and that much time is required for the assembling operation.

Further, the connection terminals must be inserted into the housing after the connection terminals are connected to the respective wires, and therefore it is difficult to use press-contacting terminals as the connection terminals, and the connection terminals have long been limited to crimp-type terminals, and it has been eagerly desired to put a waterproof connector, using press-contacting terminals, into practical use. In addition, there has existed no waterproof connector of the type in which press-contacting terminals and crimp-type terminals can be used in a mixed manner, and a connector for the press-contacting terminals and a connector for the crimp-type terminals have been provided separately, and this has prevented the wires form being installed in a simplified manner.

SUMMARY OF THE INVENTION

This invention has been made in view of the above problems, and an object of the invention is to provide a waterproof connector in which a number of wires to be connected to the connector are collectively waterproofed, and only press-contacting terminals can be used, and also press-contacting terminals and crimp-type terminals can be used in a mixed manner.

In order to achieve the above object, according to the present invention, there is provided a waterproof connector, comprising:

a tubular outer housing, which has an opening:

an inner housing, which is inserted into the tubular outer housing, and which is held in the tubular outer housing, the inner housing which includes:

a plurality of terminal receiving chambers;

a plurality of connection terminals which are provided on the terminal receiving chambers respectively; and a plurality of wires which are respectively connected to the connection terminals, and extends in the terminal receiving chambers toward an outside through the opening;

a vessel portion, which is formed by an inner circumference of end portion of the tubular outer housing at an opening side and an end face of the inner housing from which the wires are extended toward the outside; and a sealing material, which is filled in the vessel portion for waterproofing the wires collectively.

In the waterproof connector of the above construction, the plurality of inner housings, each having the plurality of terminal receiving chambers which are arranged in the plane, and receive the respective connection terminals, are stacked together, and the stacked inner housings are inserted into the outer housing through the opening thereof, and then the sealing material is filled in the vessel portion, thereby collectively waterproofing the plurality of wires. Therefore, as compared with the related waterproof connectors in which the wires are passed one by one through the rubber plug, the time, required for the operation is much reduced, so that the efficiency of the operation is greatly enhanced.

The inner housings, each receiving the connection terminals, are inserted into the outer housing, and then the waterproof treatment is collectively effected. Therefore, sub-wire harnesses, produced respectively in different processes, can be collectively inserted into the outer housing to provide the waterproof connector. And besides, press-contacting terminals (The use of such press-contacting terminals has heretofore been difficult) can be used in the waterproof connector, and therefore even when press-contacting terminals and crimp-type terminals are used in a mixed manner, these terminals can be connected to the waterproof connector in a waterproof manner.

Preferably, each of the connection terminals is a press-contacting terminal which has a press-contacting blade electrically connecting the corresponding wire by pressing the corresponding wire into the press-contacting blade.

In the waterproof connector of the above construction, each of the connection terminals of the waterproof connector is the press-contacting terminal which is electrically connected to the corresponding wire by forcing the wire into the press-contacting blade of the terminal, and therefore the connection of each wire to the connection terminal can be easily effected in an automated manner, so that the efficiency of the assembling operation of the waterproof connector can be greatly enhanced.

Preferably, the connection terminals include a press-contacting terminal and a crimp-type terminal. The press-contacting terminals has a press-contacting blade electrically connecting the corresponding wire by pressing the corresponding wire into the press-contacting blade. The crimp-type terminal is press-fastened to a conductor of the corresponding wire for electrically connection. The press-contacting terminals and the crimp-type terminals are received in the respective terminal receiving chambers in a mixed manner.

In the waterproof connector of the above construction, the press-contacting terminals and the crimp-type terminals can be used in a mixed manner as the connection terminals of the waterproof connector, and therefore the wires, connected to the press-contacting terminals, and the wires, connected to the crimp-type terminals, do not need to be installed separately, and these terminals can be connected to one waterproof connector, so that the installation of the wires can be simplified. Therefore, the installation operation can be simplified, and can be effected in a short time.

Preferably, the terminal receiving chambers are arranged in parallel. The inner housing is cut from a split type inner housing so that the inner housing has a desired unit number of the terminal receiving chambers.

In the waterproof connector of the above construction, each of the inner housings is so cut from the split type inner housing, having a large number of parallel terminal receiving chambers, that the inner housing has the desired unit number of the parallel terminal receiving chambers. Therefore, the split type inner housing can be used for a plurality of kinds of waterproof connectors, and the efficiency of the assembling operation is enhanced, and the cost of the inner housings can be reduced.

According to the present invention, there is also provided a method of assembling waterproof connector, comprising the steps of:

providing a tubular outer housing, which has an opening:

providing an inner housing, which includes:

a plurality of terminal receiving chambers;

a plurality of connection terminals which are provided on the terminal receiving chambers respectively; and a plurality of wires which are respectively connected to the connection terminals, and extends in the terminal receiving chambers toward an outside;

inserting the inner housing into the tubular outer housing through the opening so that the inner housing is held in the tubular outer housing filing a sealing material in a vessel portion for waterproofing the wires collectively, wherein the vessel portion is formed by an inner circumference of end portion of the tubular outer housing at an opening side and an end face of the inner housing from which the wires are extended toward the outside.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

One preferred embodiment of the present invention will now be described in detail with reference to FIGS. 1 to 16.

Figure 1:
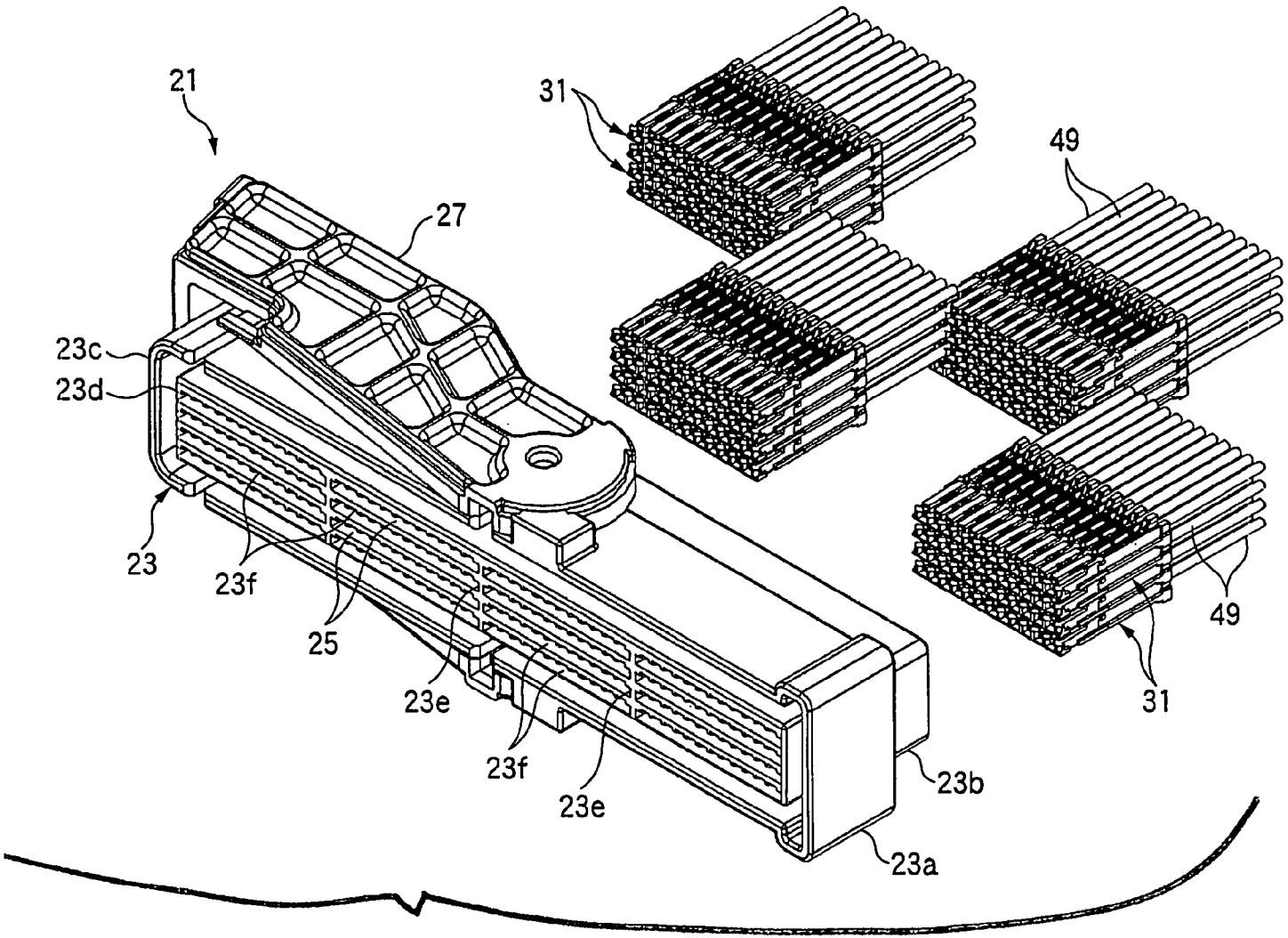
FIG. 1 is an exploded, perspective view of a multi-pole waterproof connector of the invention as seen from the front side thereof.
Figure 2:
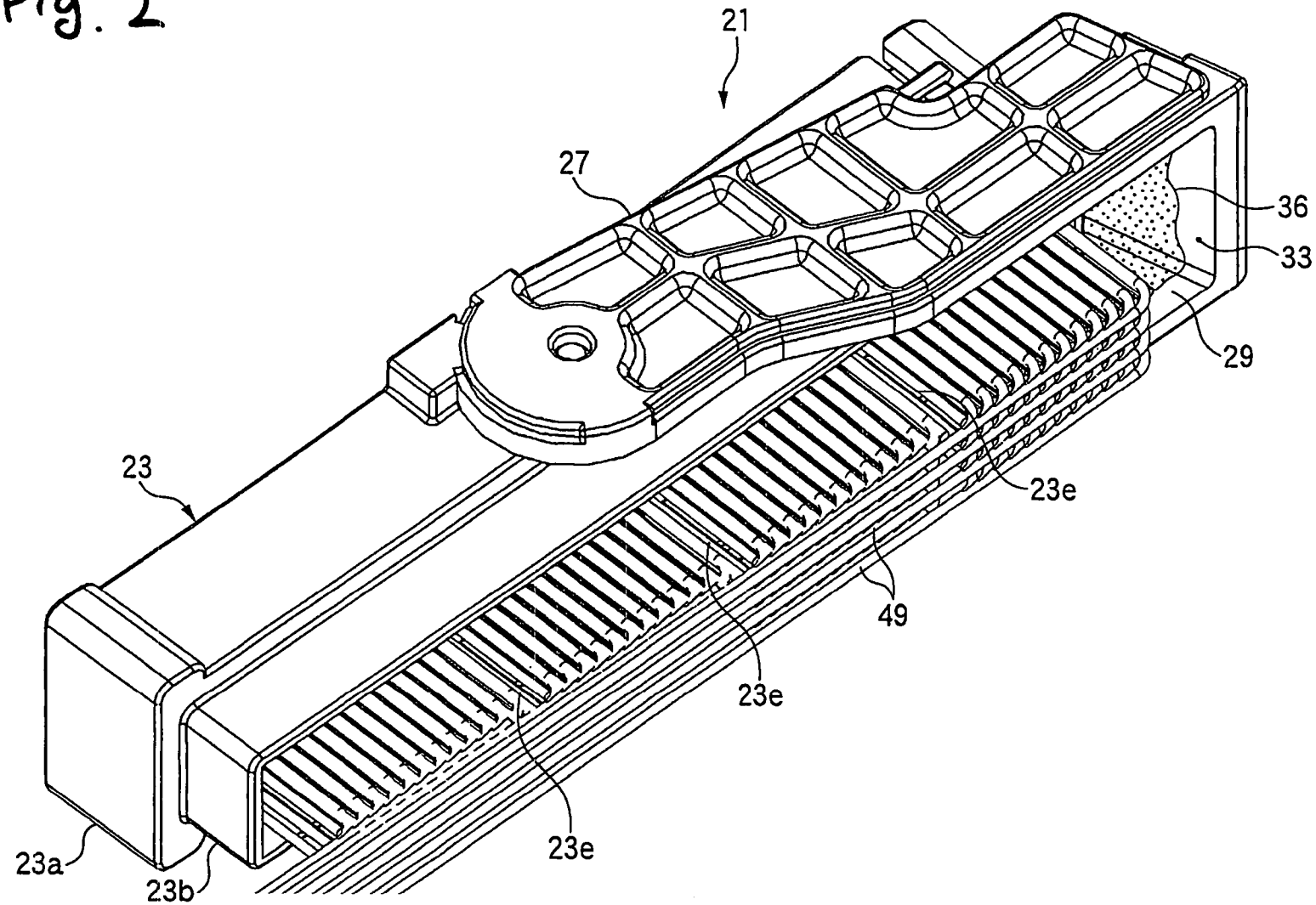
FIG. 2 is a perspective view of the multi-pole waterproof connector as seen from the rear side thereof.
Figure 3:
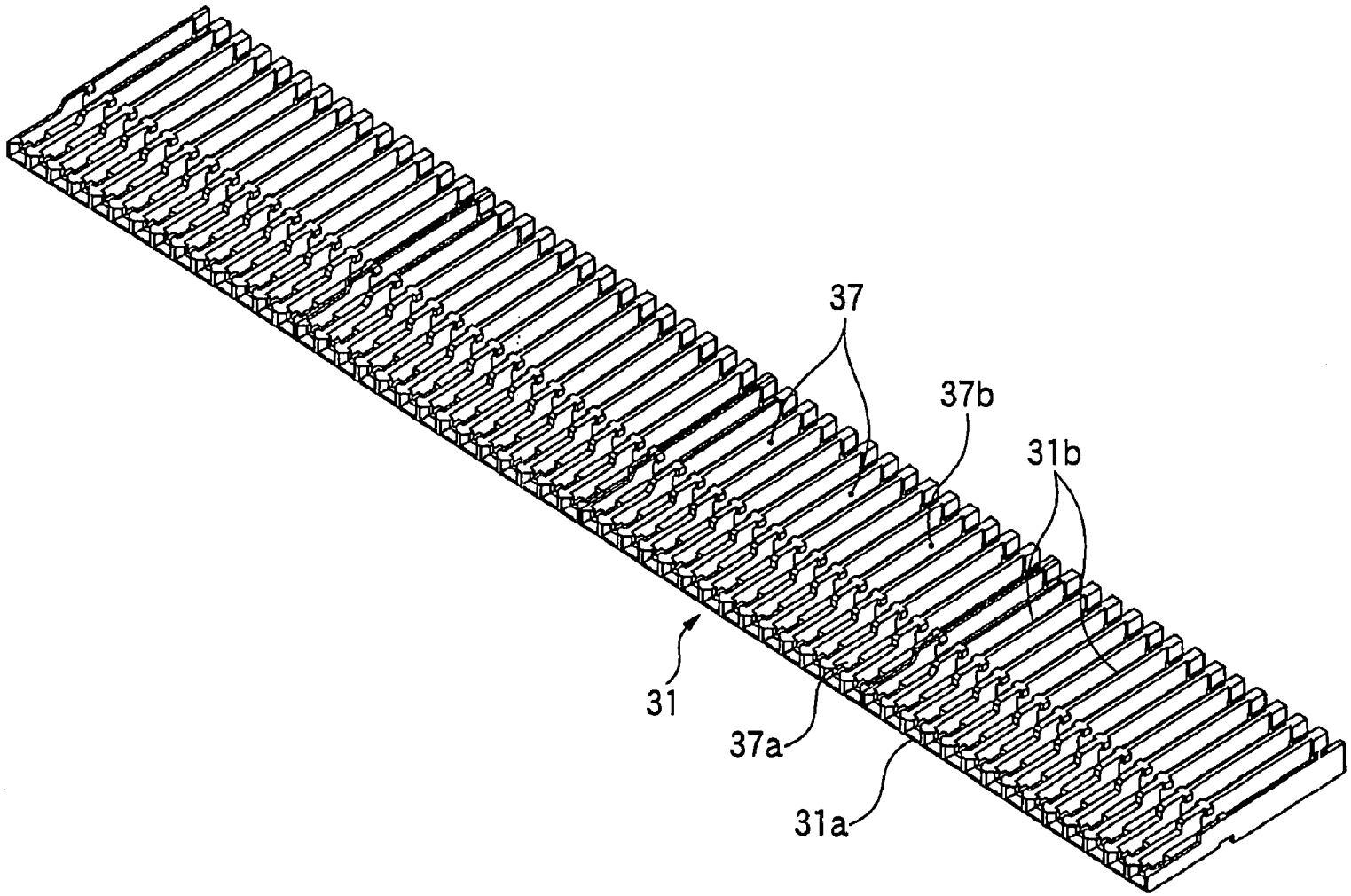
FIG. 3 is a perspective view of a split type inner housing.
Figure 4:
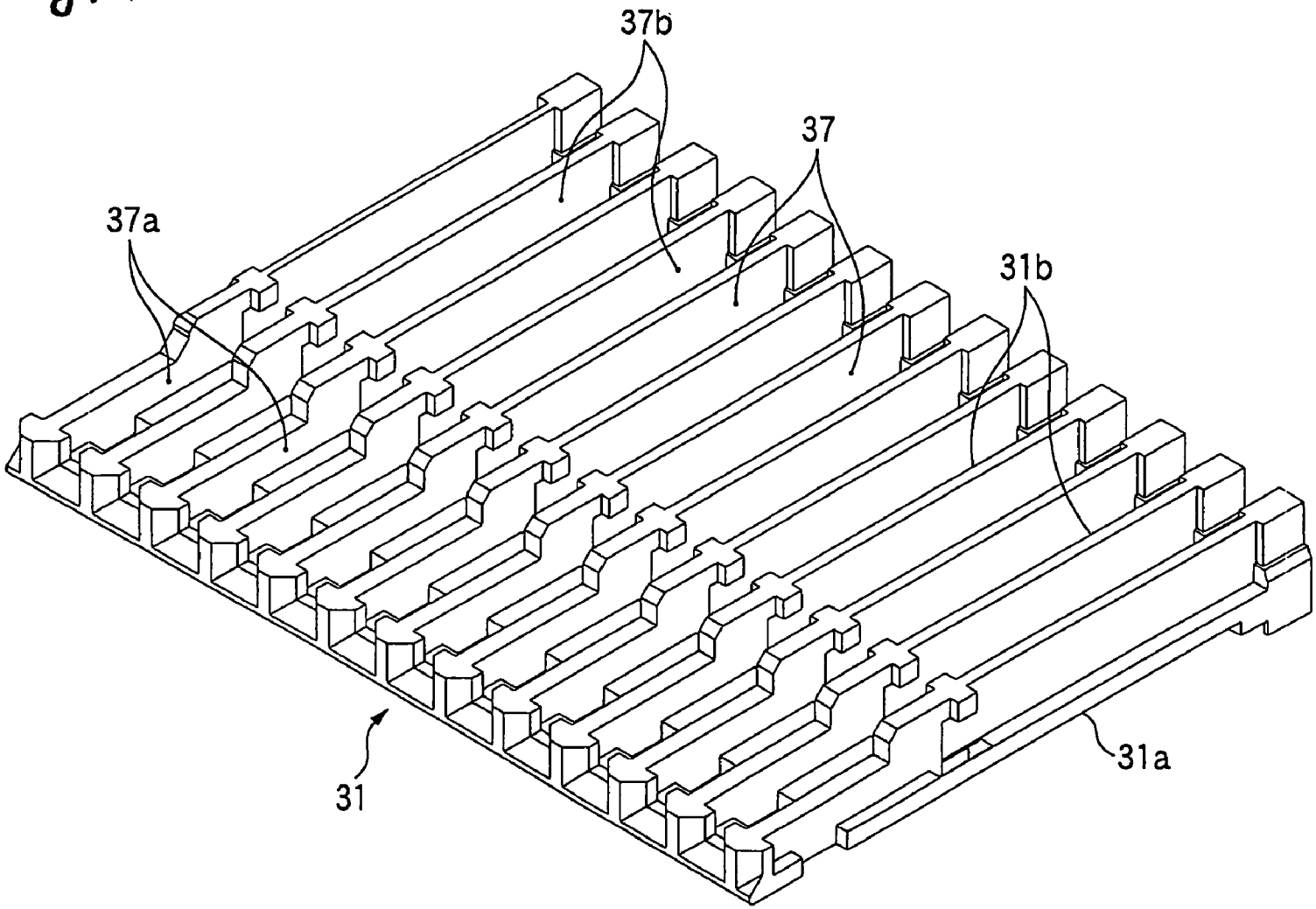
FIG. 4 is a perspective view of an inner housing which is so cut from the split type inner housing that it has a desired unit number of terminal receiving chambers.
Figure 5:
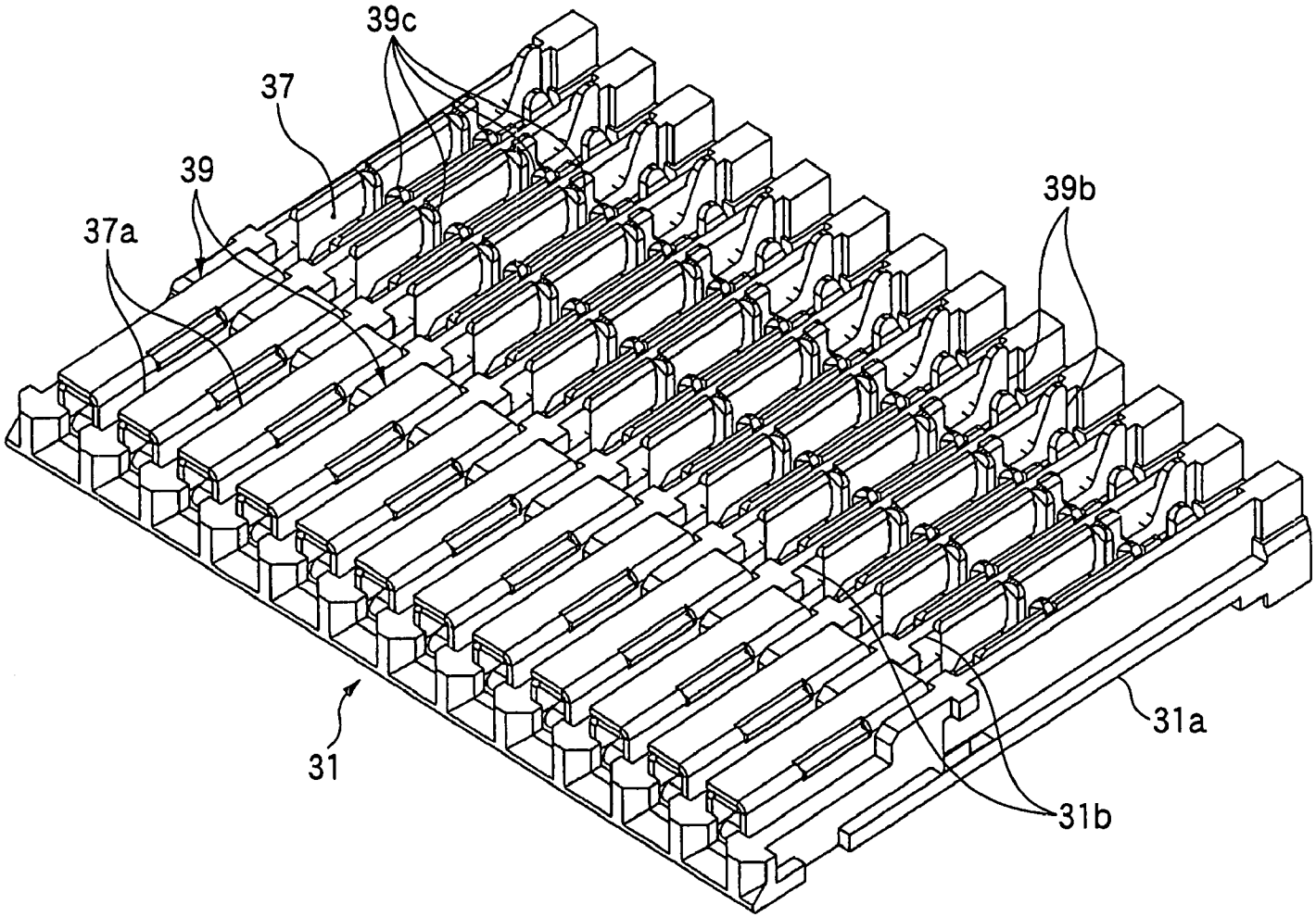
FIG. 5 is a perspective view of the inner housing, showing a condition in which press-contacting terminals are received respectively in the terminal, receiving chambers.
Figure 6:
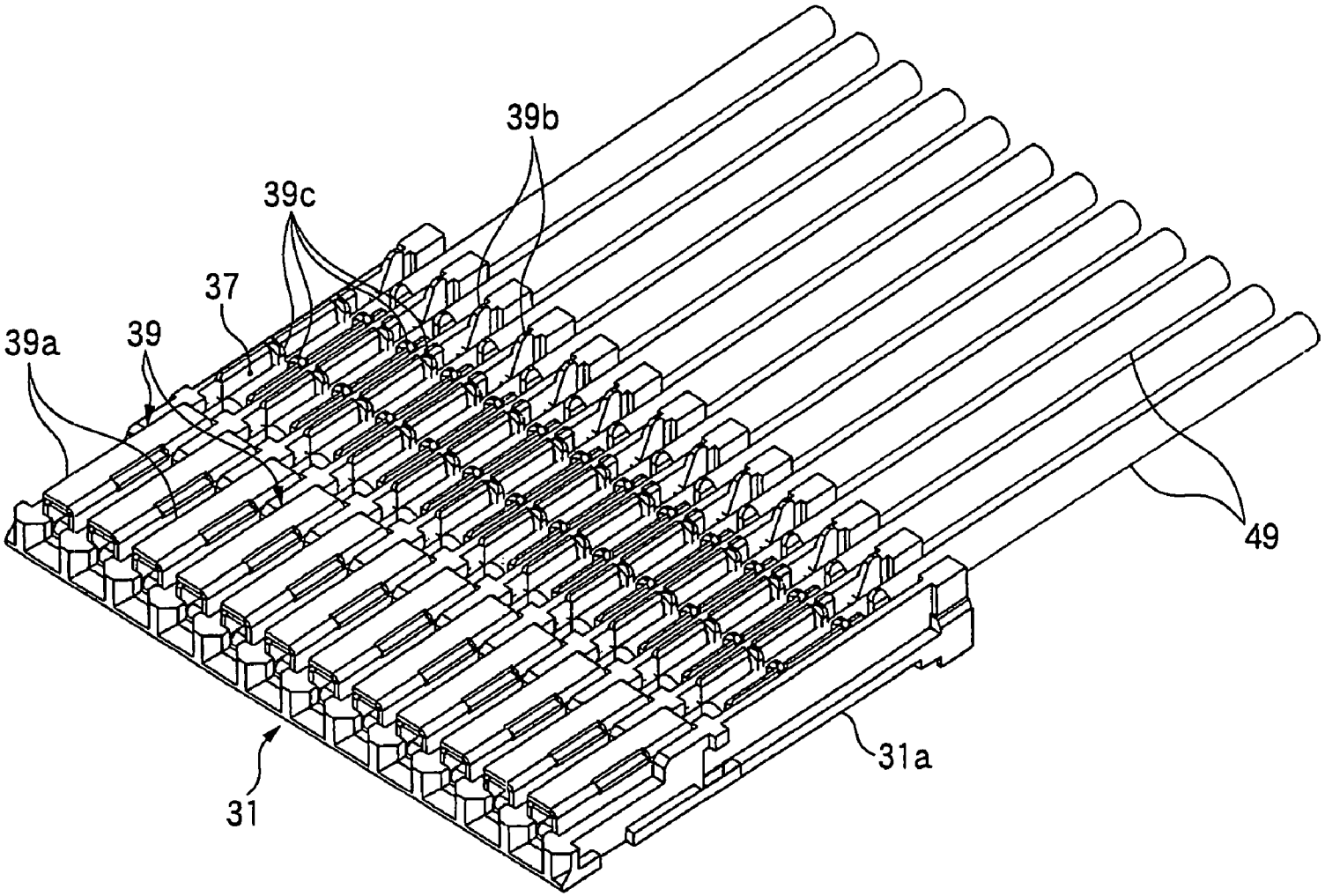
FIG. 6 is a perspective view showing a condition in which wires are press-contacted respectively with press-contacting blades of the press-contacting terminals received respectively in the terminal receiving chambers.
Figure 7:
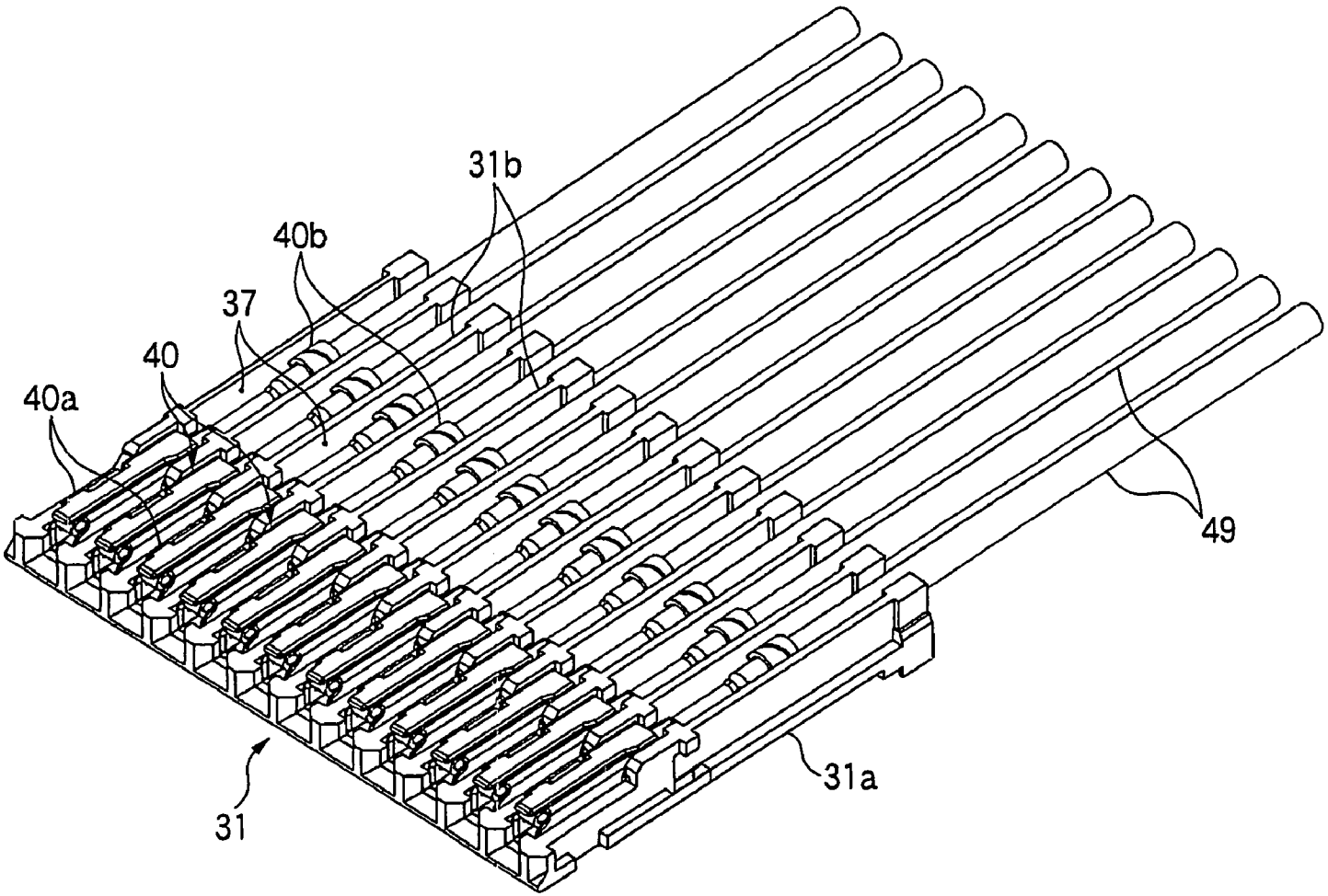
FIG. 7 is a perspective view of the inner housing showing a condition in which crimp-type terminals, press-fastened respectively to wires, are received respectively in the terminal receiving chambers.
Figure 8:
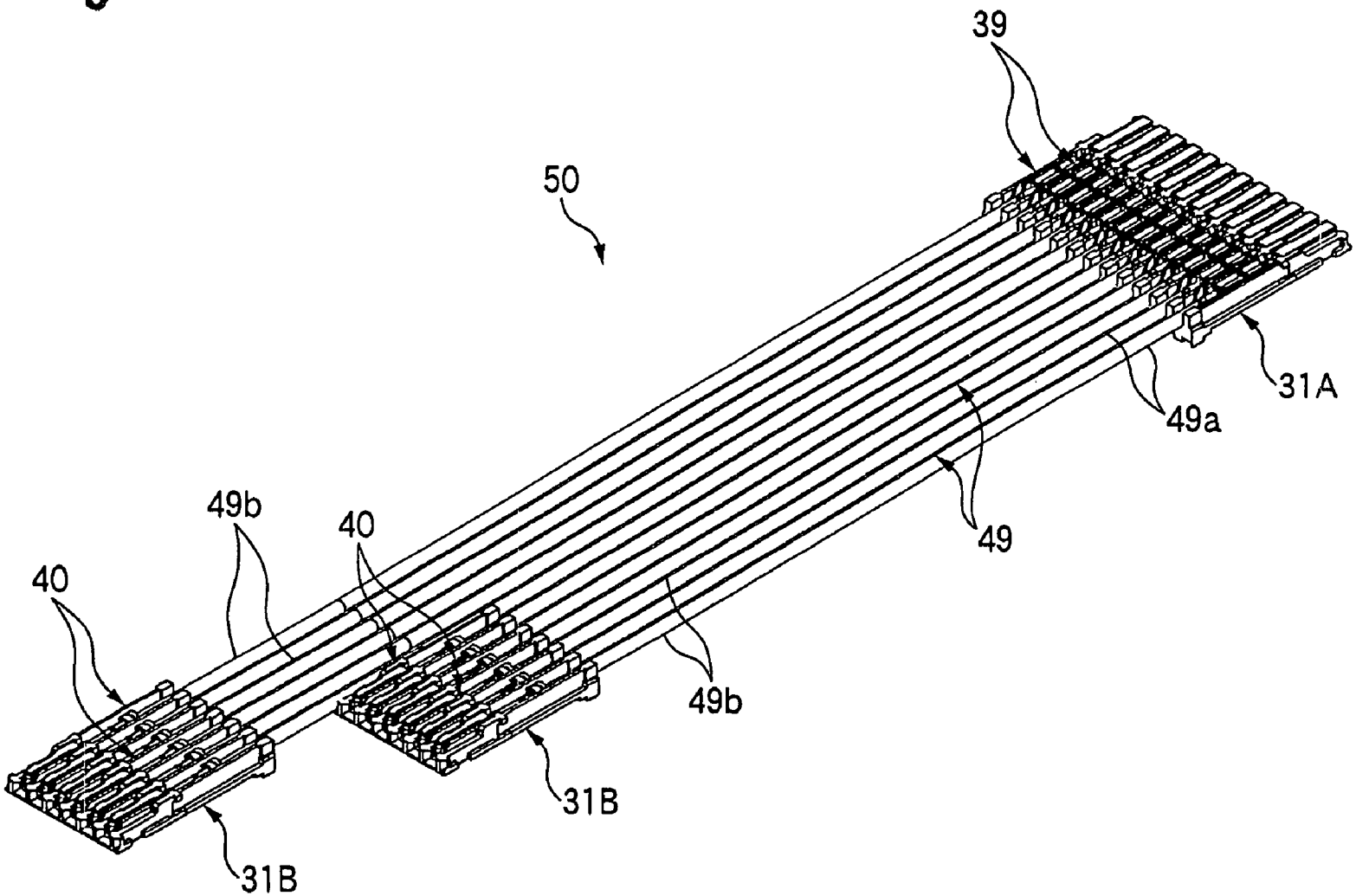
FIG. 8 is a perspective view of a sub-wire harness in which a press-contacting terminal and a crimp-type terminal are connected respectively to opposite ends of each wire, and are received respectively in terminal receiving chambers of corresponding inner housings.
Figure 9:
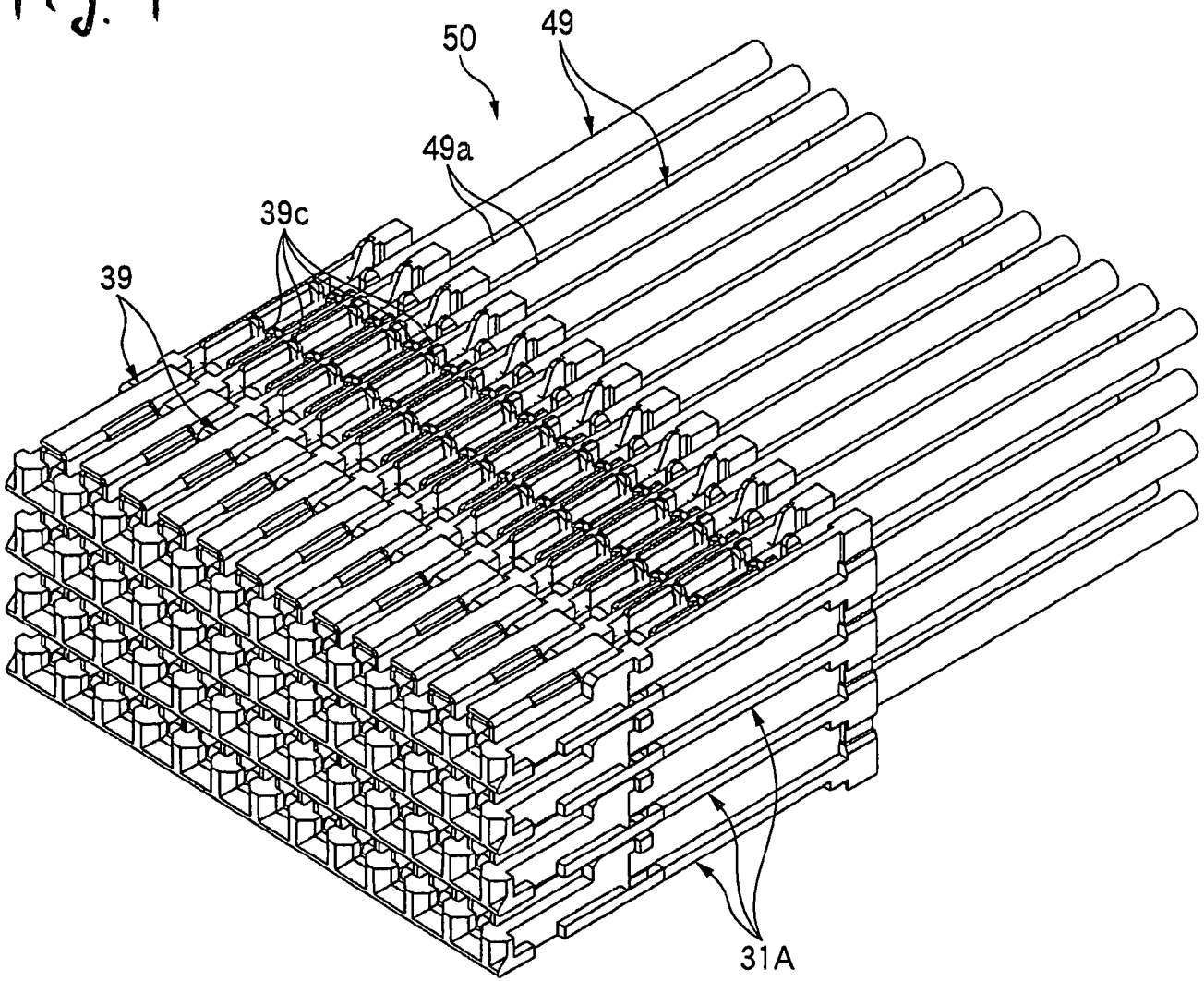
FIG. 9 is a perspective view showing a condition in which a plurality of inner housings, each receiving press-contacting terminals press-contacted respectively with wires, are stacked together.

FIG. 1 is an exploded, perspective view of a multi-pole waterproof connector of the invention as seen from the front side thereof, FIG. 2 is a perspective view of the multi-pole waterproof connector as seen from the rear side thereof, FIG. 3 is a perspective view of a split type inner housing, FIG. 4 is a perspective view of an inner housing which is so cut from the split type inner housing that it has a desired unit number of terminal receiving chambers, FIG. 5 is a perspective view of the inner housing, showing a condition in which press-contacting terminals are received respectively in the terminal receiving chambers, FIG. 6 is a perspective view showing a condition in which wires are press-contacted respectively with press-contacting blades of the press-contacting terminals received respectively in the terminal receiving chambers, FIG. 7 is a perspective view of the inner housing showing a condition in which crimp-type terminals, press-fastened respectively to wires, are received respectively in the terminal receiving chambers, FIG. 8 is a perspective view of a sub-wire harness in which a press-contacting terminal and a crimp-type terminal are connected respectively to opposite ends of each wire, and are received respectively in terminal receiving chambers of corresponding inner housings, and FIG. 9 is a perspective view showing a condition in which a plurality of inner housings, each receiving press-contacting terminals press-contacted respectively with wires, are stacked together.

Figure 10:
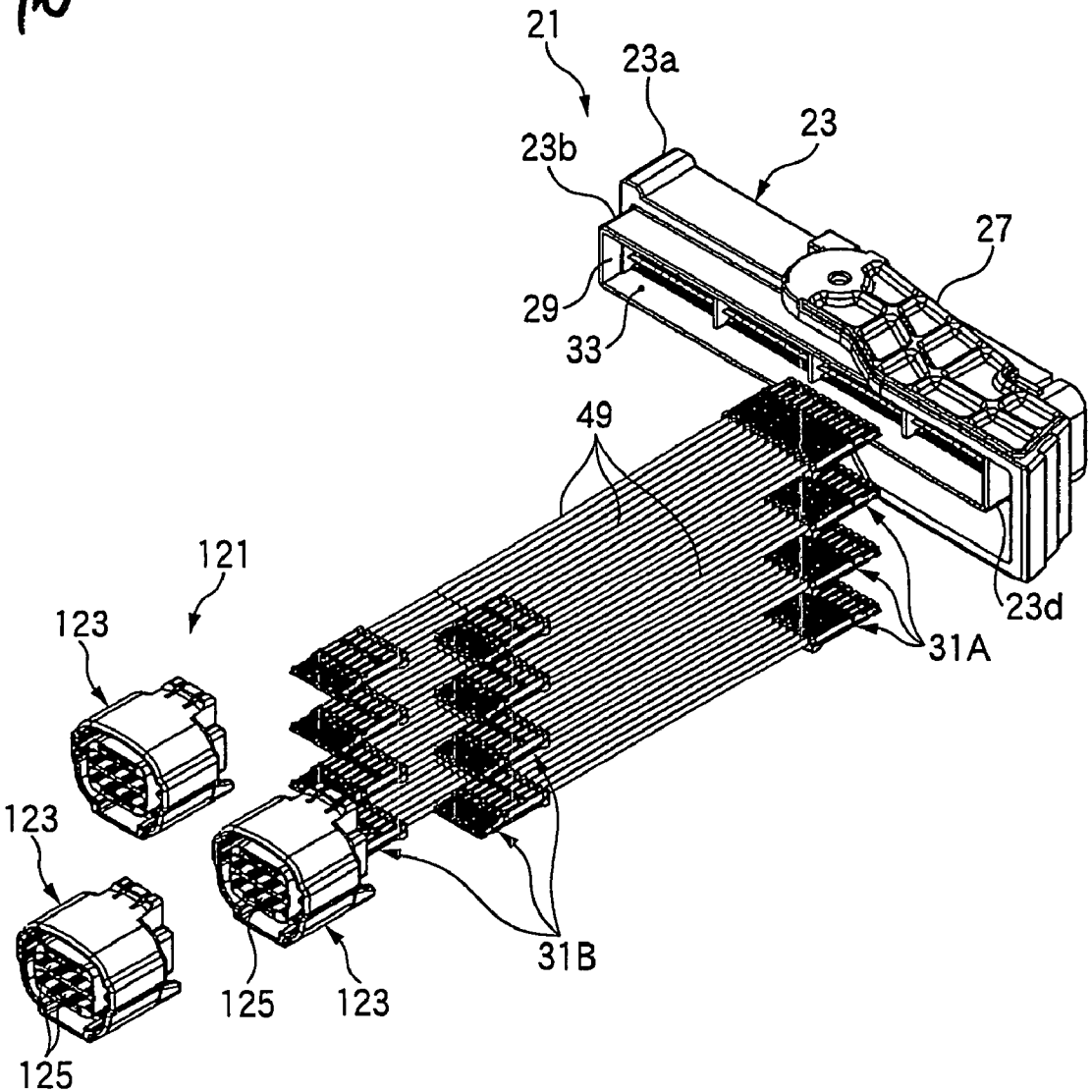
FIG. 10 is a perspective view of a wire harness in which wires are connected at one ends to the multi-pole waterproof connector, and are connected at the other ends to a plurality of small-number-pole waterproof connectors.
Figure 11:
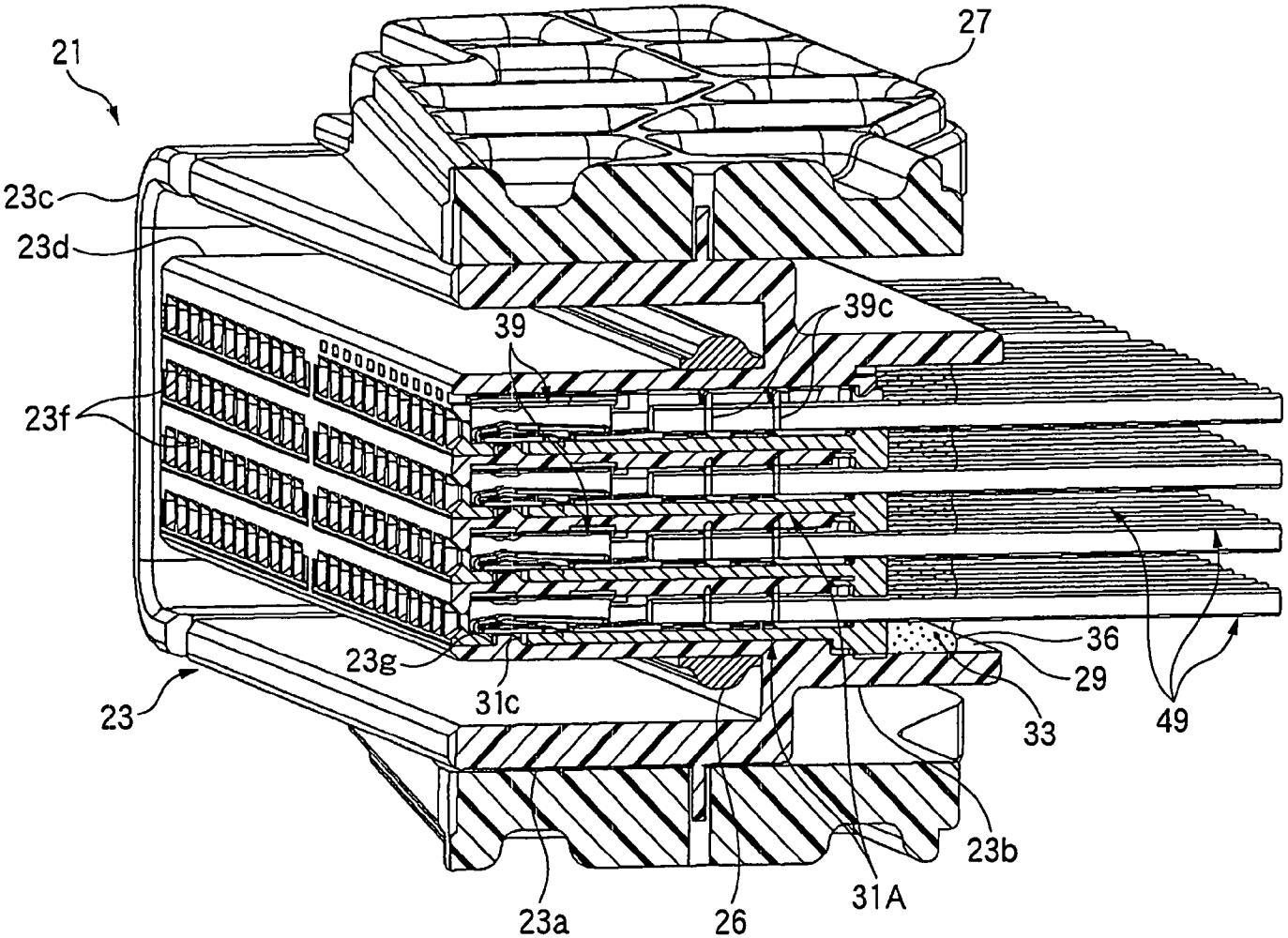
FIG. 11 is a cross-sectional, perspective view showing a condition in which the stacked inner housings are inserted in an outer housing of the multi-pole connector.
Figure 12:
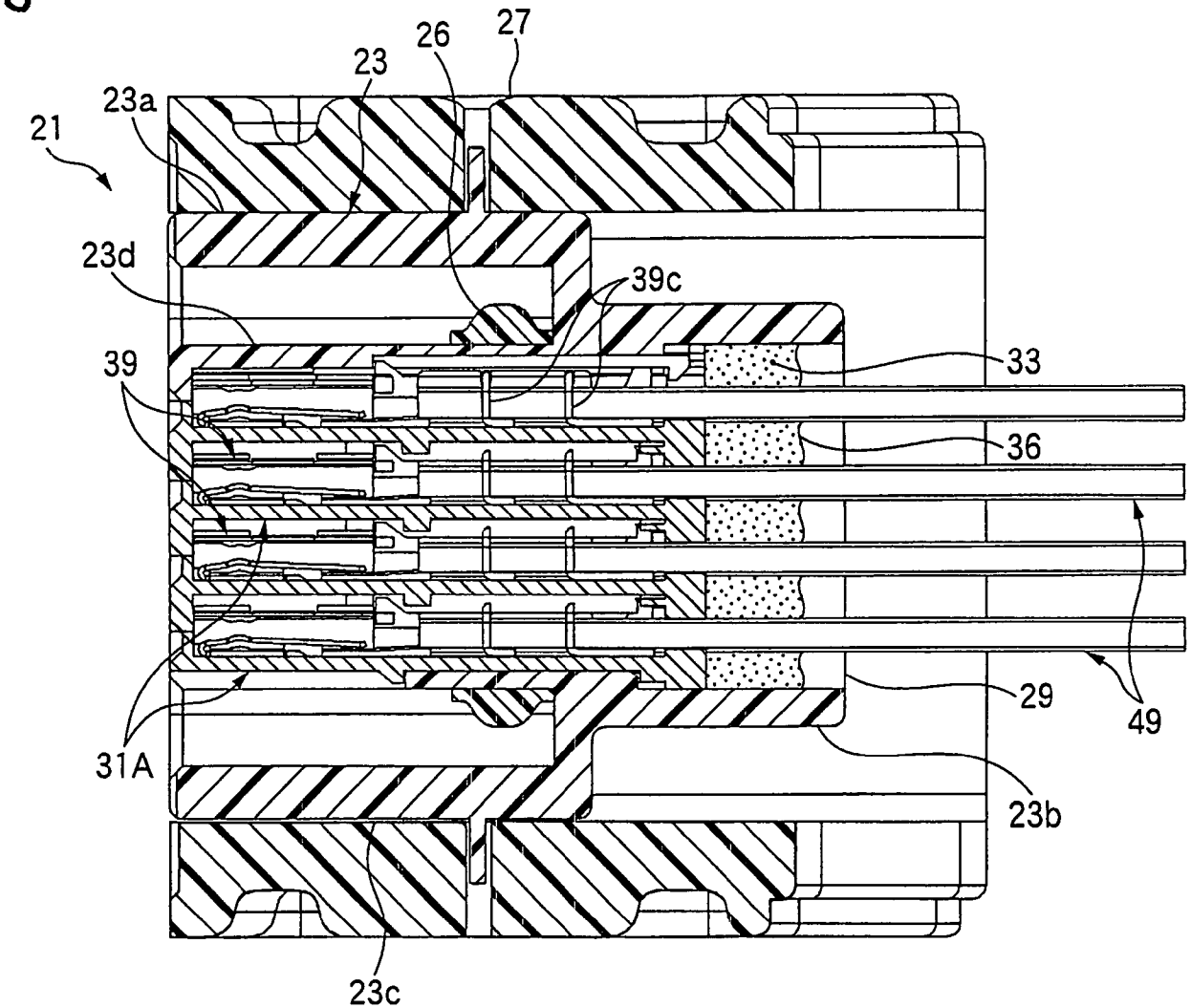
FIG. 12 is a vertical cross-sectional view of the multi-pole waterproof connector in which a sealing material is filled in a sealing material-filling vessel portion of the outer housing (in which the inner housings are inserted) to effect a waterproof treatment.
Figure 13:
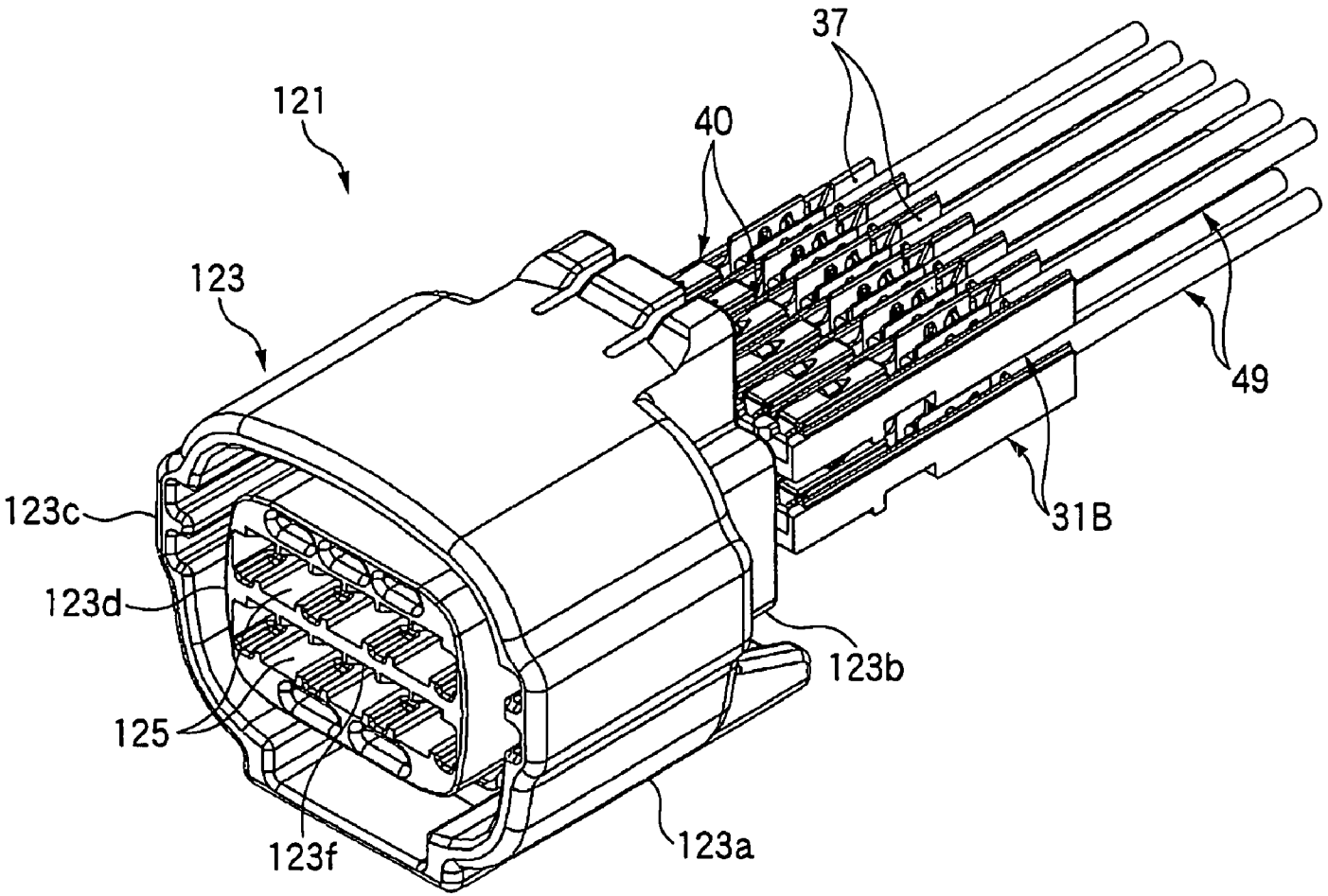
FIG. 13 is an exploded, perspective view of the small-number-pole waterproof connector as seen from the front side thereof.
Figure 14:
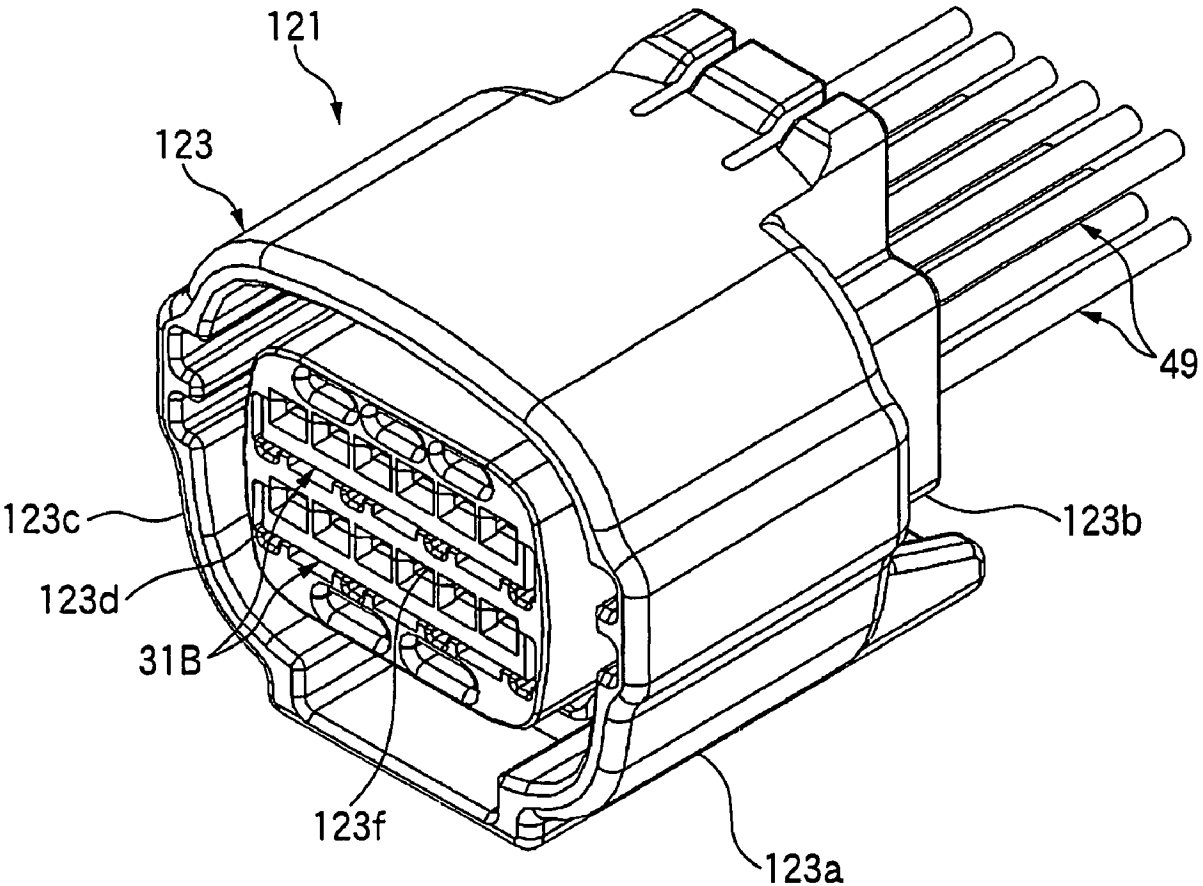
FIG. 14 is a perspective view of the small-number-pole waterproof connector as seen from the front side thereof.
Figure 15:
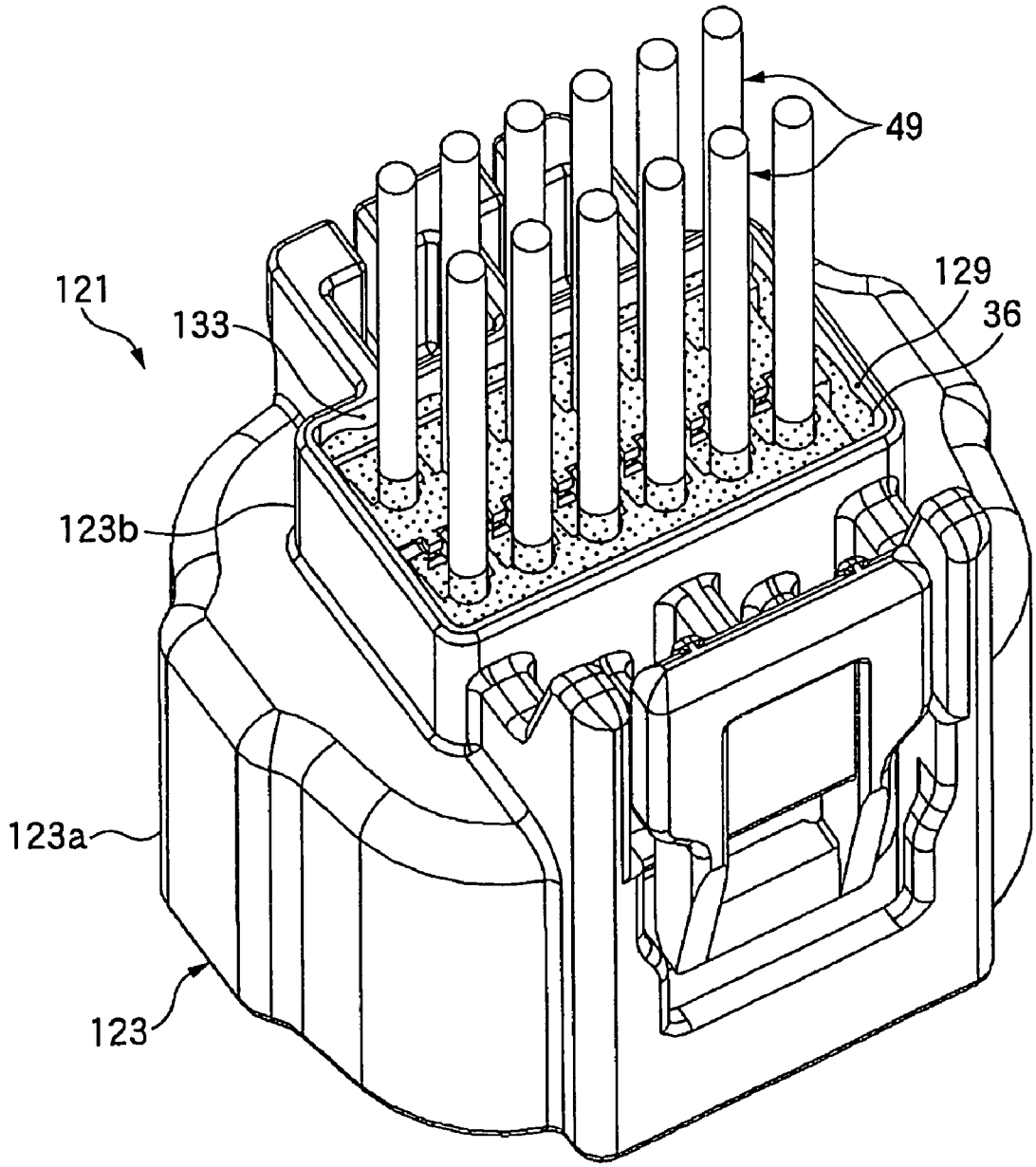
FIG. 15 is a perspective view of the small-number-pole waterproof connector as seen from the rear side thereof.
Figure 16:
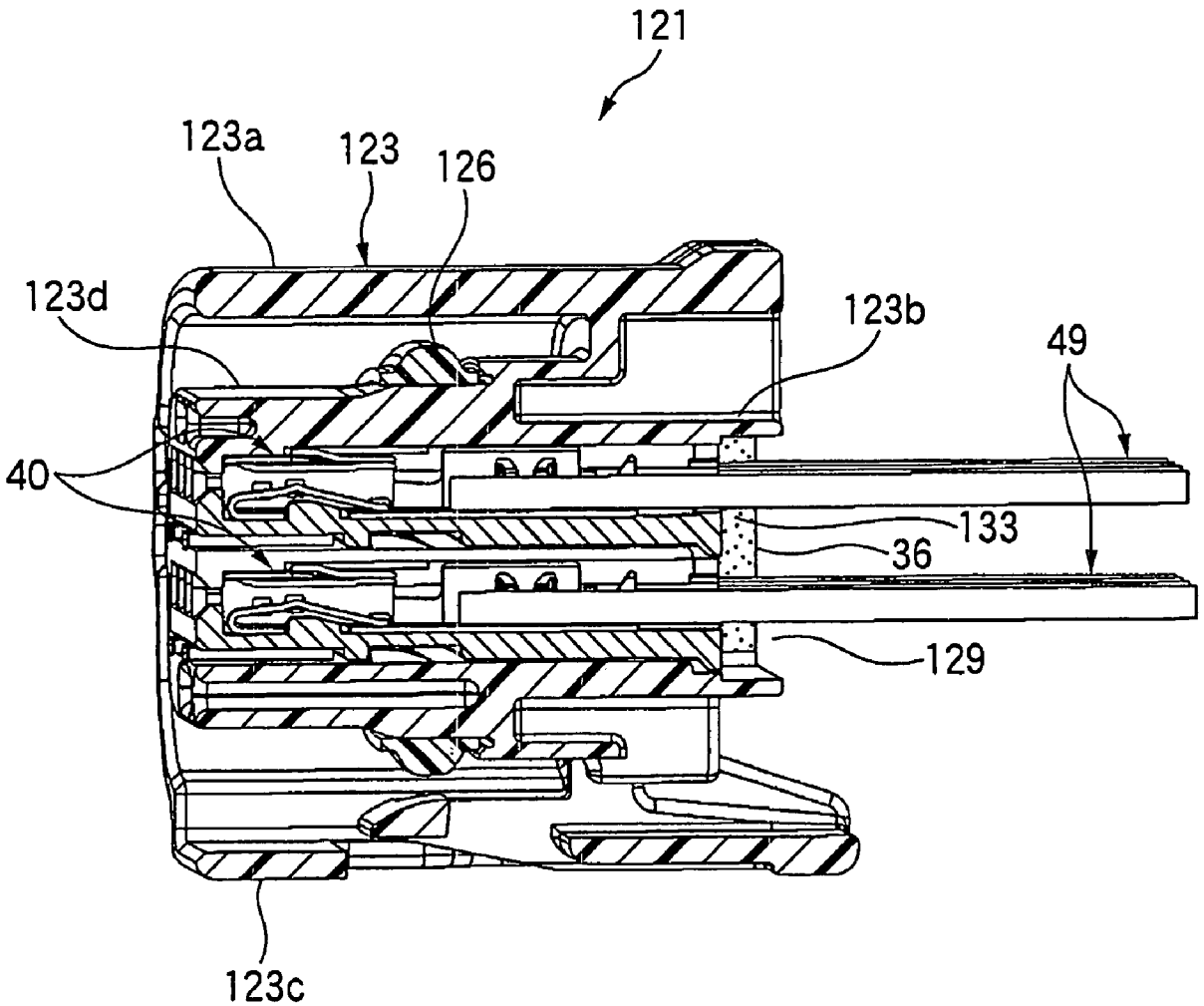
FIG. 16 is a vertical cross-sectional view of the small-number-pole connector in which a sealing material is filled in a sealing material-filling vessel portion of an outer housing (in which inner housings are inserted) to effect a waterproof treatment.

FIG. 10 is a perspective view of a wire harness in which wires are connected at one ends to the multi-pole waterproof connector, and are connected at the other ends to a plurality of small-number-pole waterproof connectors, FIG. 11 is a cross-sectional, perspective view showing a condition in which the stacked inner housings are inserted in an outer housing of the multi-pole connector, FIG. 12 is a cross-sectional view of the multi-pole waterproof connector in which a sealing material is filled in a sealing material-filling vessel portion of the outer housing (in which the inner housings are inserted) to effect a waterproof treatment, FIG. 13 is an exploded, perspective view of the small-number-pole waterproof connector as seen from the front side thereof, FIG. 14 is a perspective view of the small-number-pole waterproof connector as seen from the front side thereof, FIG. 15 is a perspective view of the small-number-pole waterproof connector as seen from the rear side thereof, and FIG. 16 is a cross-sectional view of the small-number-pole connector in which a sealing material is filled in a sealing material-filling vessel portion of an outer housing (in which inner housings are inserted) to effect a waterproof treatment. In this specification, for description purposes, "the front side" means that side of the waterproof connector for fitting connection to a mating connector, and "the rear side" means that side of the waterproof connector from which the wires extend outwardly.

As shown in FIG. 1, the waterproof connector (multi-pole waterproof connector) 21 of the invention includes the tubular outer housing 23 which is injection molded into a generally rectangular parallelepiped shape, using a synthetic resin. The outer housing 23 includes a tubular body portion 23*a* capable of receiving a plurality of stacks of inner housings 31 in a juxtaposed manner, and a tubular frame portion 23*b* formed integrally with and extending rearwardly from the body portion 23*a*.

The body portion 23*a* is of a double-wall construction, and therefore has an outer tubular portion 23*c* and an inner tubular portion 23*d*. A packing 26 (FIG. 11) is fitted on the outer periphery of the inner tubular portion 23*d*. When the mating connector (not shown) is inserted between the outer tubular portion 23*c* and the inner tubular portion 23*d*, the packing 26 is held in intimate contact with an inner peripheral surface of a mating connector housing to form a waterproof seal. The front surface of the inner tubular portion 23*d* are divided into sections by vertical ribs 23*e* and horizontal ribs 23*f*, and a plurality of terminal entry ports 25 (into which electrical contact portions of mating connection terminals (not shown) are inserted) are formed in the front surface, and are arranged in rows and columns. A lever 27 for reducing an insertion force required for fitting the waterproof connector on the mating connector is pivotally mounted on upper and lower outer surfaces of the outer housing 23.

As shown in FIG. 2, the outer housing 23 is open at its rear end, and therefore has a rear opening 29. The plurality of stacks of plate-like inner housings 31 can be inserted into the outer housing 23 through the rear opening 29 in a juxtaposed manner. The interior of the outer housing 23 is partitioned by the vertical ribs 23*e* into sections corresponding respectively to the stacks of inner housings 31. The outer housing 23 has the sealing material-filling vessel portion 33 which is defined by the inner housings 31, inserted in the body portion 23*a*, and the tubular frame portion 23*b* extending rearwardly from the body portion 23*a*.

As shown in FIG. 3, the split type inner housing 31 is injection molded of an insulative synthetic resin, and a number of terminal receiving chambers 37 are formed on an upper surface of a flat plate portion 31*a*, and are separated from one another by partition walls 31*b*, and are disposed at predetermined intervals in parallel relation to one another. In the split type inner housing 31, an arbitrary (desired) number of terminal receiving chambers is selected, and the split type inner housing 31 is cut at a relevant portion thereof between the adjacent terminal receiving chambers 37 to provide the inner housing 31 having the desired number of terminal receiving chambers 37.

As shown in FIG. 4, each of the terminal receiving chambers 37 is formed into an upwardly-open groove-like shape, and a front portion 37*a* of the terminal receiving chamber 37 forms a space for receiving an electrical contact portion 39*a* of a press-contacting terminal 39 (which is one example of connection terminals) or an electrical contact portion 40*a* of a crimp-type terminal 40 (which is one example of the connection terminals), while a rear portion 37*b* of the terminal receiving chamber 37 forms a space for receiving an electrical press-contacting portion 39*b* of the press-contacting terminal 39 or an electrical clamping portion 40*b* of the crimp-type terminal 40 (see FIGS. 6 and 7). The inner housing 31 of FIG. 4 is so cut from the split type inner housing 31 that it has 12 terminal receiving chambers 37.

As shown in FIG. 5, the press-contacting terminal 39 is an electrically-conductive member produced by pressing an electrical-conductive material (such as metal). The electrical contact portion 39*a* is formed at a front portion of the terminal 39, and the electrical press-contacting portion 39*b* is formed at a rear portion thereof extending from the front portion thereof, and a pair of press-contacting blades 39*c* are formed at the electrical press-contacting portion 39*b*. The press-contacting terminal 39 is received in the terminal receiving chamber 37 in such a manner that the press-contacting blades 39*c* are open upwardly. When a wire 49 is pressed against the press-contacting blades 39*c* of the press-contacting terminal 39 received in the terminal receiving chamber 37, a sheath of the wire 49 is cut by the press-contacting blades 39*c*, and a conductor (not shown) of the wire 49 is brought into contact with the press-contacting blades 39*c*, thereby electrically connecting the wire 49 to the press-contacting terminal 39 as shown in FIG. 6. The wire 49 extends rearwardly from the rear portion 37*b* of the terminal receiving chamber 37.

As shown in FIG. 7, the crimp-type terminal 40 is an electrically-conductive member produced by pressing an electrical-conductive material (such as metal). The box-like electrical contact portion 40*a* is formed at a front portion of the terminal 40, and clamping piece portions, serving as the electrical clamping portion 40*b*, are formed at a rear portion thereof extending from the front portion thereof. For press-fastening the terminal 40 to a wire 49 first, a sheath is removed from one end portion of the wire 49 to expose a conductor thereof, and then the electrical clamping portion 40*b* is pressed by a press-clamping tool in such a manner that the press-clamping piece portions are wound on the conductor. The crimp-type terminal 40, press-fastened to the wire 49, is received in the terminal receiving chamber 37 of the inner housing 31, and the wire 49 is extended rearwardly from the rear portion 37*b* of the terminal receiving chamber 37.

The connection terminals are connected to the opposite ends of wires 49 as described above, thereby forming the sub-wire harness 50. In the sub-wire harness 50 shown in FIG. 8, press-contacting terminals 39 are press-connected respectively to one ends 49*a* of 12 wires 49, and are received in an inner housing 31A having 12 terminal receiving chambers 37, and crimp-type terminals 40 are press-connected respectively to the other ends of six of the 12 wires 49, and are received in an inner housing 31B having six terminal receiving chambers 37, and also crimp-type terminals 40 are press-connected respectively to the other ends of the other six wires 49, and are received in another inner housing 31B having six terminal receiving chambers 37.

As shown in FIG. 9, the inner housings 31A, each having 12 press-contacting terminals 39 (each connected to the wire 49) received respectively in the terminal receiving chambers 37, are stacked together in a multi-stage manner (that is, stacked in four stages in the illustrated embodiment), and the stacked inner housings 31A are inserted into the inner tubular portion 23*d* of the multi-pole waterproof connector 21 as shown in FIG. 10. The inner housings 31B, each having 6 crimp-type terminals 40 each connected to the wire 49) received respectively in the terminal receiving chambers 37, are stacked in two stages, and the stacked inner housings 31B are inserted into an inner tubular portion 123*d* of the small-number-pole waterproof connector 121 (see FIG. 13).

As shown in FIGS. 11 and 12, the inner housings 31A, stacked in four stages, are inserted into the inner tubular portion 23*d* of the outer housing 23 through the rear opening 29. FIG. 11 shows an example (see FIG. 1) in which the horizontal ribs 23 are formed on the outer housing 23, and the terminal entry ports 25, corresponding respectively to the inner housings 31, are separated from one another. Retaining portions 23*g*, formed on and projecting from the upper surface of each horizontal rib 23*f*, are engaged respectively in retaining holes 31*c* formed in the flat plate portion 31*a* of the corresponding inner housing 31, thereby preventing the rearward withdrawal of the inner housing 31. FIG. 12 shows an example in which any horizontal rib is not formed on the outer housing 23, and the inner housings 31A, stacked in four stages, are collectively inserted into the inner tubular portion 23*d* of the outer housing 23 through the rear opening 29.

The multi-pole waterproof connector 21, shown in FIG. 1, can receive four stacks of inner housings 31A (each stack comprising the inner housings 31 stacked in four stages) in a juxtaposed manner. 12 press-contacting terminals 39 are received in each inner housing 31A, and therefore a total of 192 press-contacting terminals 39 can be mounted in the multi-pole waterproof connector 21, and a large number of wires can be connected to the connector.

As shown in FIGS. 11 and 12, the wires 49, extending rearwardly from the stacked inner housings 31A inserted in the inner tubular portion 23*d* of the outer housing 23, pass through the sealing material-filling vessel portion 33 whose periphery is defined by the tubular frame portion 23*b*. Therefore, by filling a sealing material 36 in the sealing material-filling vessel portion 33, a large number of (192 in the example shown in FIG. 11) wires 49 are collectively waterproofed. Ultraviolet-curing rubber, RTV silicone rubber (a one-pack type or a two-pack type), foamed urethane, a hot melt or others can be used as the sealing material 36.

As shown in FIG. 13, the inner housings 31B, each having 6 crimp-type terminals 40 received respectively in the terminal receiving chambers 37, are stacked in two stages, and are inserted into the small-number-pole waterproof connector 121 through a rear opening 129 thereof. The small-number-pole waterproof connector 121, shown in FIG. 13, is a 12-pin connector, and includes an outer housing 123 of a generally rectangular parallelepiped shape injection molded of an insulative synthetic resin.

As shown in FIGS. 13 and 14, the outer housing 123 includes a tubular body portion 123*a* capable of receiving stacked inner housings 31B, and a tubular frame portion 123*b* formed integrally with and extending rearwardly from the body portion 123*a*. The body portion 123*a* is of a double-wall construction, and therefore has an outer tubular portion 123*c* and the inner tubular portion 123*d*. A packing 126 is fitted on the outer periphery of the inner tubular portion 123*d* (see FIG. 16). When a mating connector (not shown) is inserted between the outer tubular portion 123*c* and the inner tubular portion 123*d*, the packing 126 is held in intimate contact with an inner peripheral surface of a mating connector housing to form a waterproof seal. The front surface of the inner tubular portion 123*d* are divided into sections by horizontal ribs 123*f* and a plurality of terminal entry ports 125 (into which electrical contact portions of mating connection terminals (not shown) are inserted) are formed in the front surface, and are arranged in two rows in the upward-downward direction.

As shown in FIG. 15, the outer housing 123 is open at its rear end, and therefore has the rear opening 129. The plate-like inner housings 31B, stacked in two stages, can be inserted into the outer housing 123 through the rear opening 129. The outer housing 123 has a sealing material-filling vessel portion 133 which is defined by the inner housings 31B, inserted in the body portion 123*a*, and the tubular frame portion 123*b* extending rearwardly from the body portion 123*a*.

As shown in FIGS. 15 and 16, the wires 49, extending rearwardly from the inner housings 31B (stacked in two stages) inserted in the inner tubular portion 123*d* of the outer housing 123, pass through the sealing material-filling vessel portion 133 whose periphery is defined by the tubular frame portion 123*b*. By filling a sealing material 36 in the sealing material-filling vessel portion 133, many (12 in the example shown in FIG. 15) wires 49 are collectively waterproofed. Ultraviolet-curing rubber, RTV silicone rubber (a one-pack type or a two-pack type), foamed urethane, a hot melt or others can be used as the sealing material 36.

As described above, in the multi-pole waterproof connector 21 and the small-number-pole waterproof connector 121, the front end is waterproofed by the packing 26, 126 held in intimate contact with the inner peripheral surface of the mating connector housing, while the rear end is waterproofed by the sealing material 36 filled in the sealing material-filling vessel portion 33, 133. The terminals to be received in the respective terminal receiving chambers 37 of the inner housing 31 are not limited to any specified kind, and the press-contacting terminals 39 or the crimp-type terminals 40 can be used. And besides, the press-contacting terminals 39 and the crimp-type terminals 40 can be used in a mixed manner, in which case the terminals can be handled in the same manner, and the waterproof treatment can be effected. The wires 49 are waterproofed by filling the sealing material 36 in the sealing material-fitting vessel portion 33, 133, and therefore the inner housings 31 of the non-waterproof type can be used, and besides the waterproof treatment can be effected quite easily and positively regardless of the number of wires 49 to be installed.

The present invention is not limited to the above embodiments, and suitable modifications, improvements and others can be made. The material, shape, dimensions, numerical values, form, number, mounting position, etc., of each of the constituent elements are arbitrary, and are not limited in so far as the invention can be achieved.

In the above embodiment, the sub-wire harnesses are stacked together in a multi-stage manner, and the stacked sub-wire harnesses are inserted into the outer housing. However, the invention is not limited to such a construction, and a single sub-wire harness can be inserted into the outer housing.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A waterproof connector, comprising:

a tubular outer housing, which has a rear opening:

an inner housing, which is inserted into the tubular outer housing, and which is held in the tubular outer housing through the rear opening, the inner housing which includes:

a plurality of terminal receiving chambers;

a plurality of connection terminals which are provided in the terminal receiving chambers respectively; and a plurality of wires which are respectively connected to the connection terminals, and extend in the terminal receiving chambers toward the outside through the rear opening;

a vessel portion, which is formed by an inner circumference of an end portion of the tubular outer housing at the rear opening and an end face of the inner housing from which the wires extend toward the outside; and a sealing material, which is filled in the vessel portion for waterproofing the wires collectively.

2. The waterproof connector according to claim 1, wherein each of the connection terminals is a press-contacting terminal which has a press-contacting blade electrically connected to the corresponding wire by pressing the corresponding wire into the press-contacting blade.

3. The waterproof connector according to claim 1, wherein the connection terminals include a press-contacting terminal and a crimp-type terminal;

wherein the press-contacting terminals each have a press-contacting blade electrically connected to the corresponding wire by pressing the corresponding wire into the press-contacting blade; and wherein the crimp-type terminal is press-fastened to a conductor of the corresponding wire for electrically connection.

4. The waterproof connector according to claim 1, wherein the terminal receiving chambers are arranged in parallel; and wherein the inner housing is cut from a split type inner housing so that the inner housing has a desired unit number of the terminal receiving chambers.

5. A method of assembling waterproof connector, comprising the steps of:

providing a tubular outer housing, which has a rear opening:

providing an inner housing, which includes:

a plurality of terminal receiving chambers;

a plurality of connection terminals which are provided in the terminal receiving chambers respectively; and a plurality of wires which are respectively connected to the connection terminals, and extend in the terminal receiving chambers toward the outside;

inserting the inner housing into the tubular outer housing through the rear opening so that the inner housing is held in the tubular outer housing filing a sealing material in a vessel portion for waterproofing the wires collectively, wherein the vessel portion is formed by an inner circumference of an end portion of the tubular outer housing at the rear opening and an end face of the inner housing from which the wires are extended toward the outside.

* * * * *